US009862534B2

(12) United States Patent
Van Den Broek et al.

(10) Patent No.: US 9,862,534 B2
(45) Date of Patent: Jan. 9, 2018

(54) DISPENSER AND METHOD FOR DISPENSING PRISMATIC TABLETS

(71) Applicant: BBBprojects B.V., Baam (NL)

(72) Inventors: Lucas Karel Johannes Van Den Broek, Zeewolde (NL); Richard Patrick Versluijs, Delfgauw (NL)

(73) Assignee: BBBprojects B.V., Baam (NL)

( * ) Notice: Subject to any disclaimer, the term of this patent is extended or adjusted under 35 U.S.C. 154(b) by 0 days.

(21) Appl. No.: 14/904,973

(22) PCT Filed: Jul. 15, 2014

(86) PCT No.: PCT/NL2014/050483

§ 371 (c)(1),
(2) Date: Jan. 14, 2016

(87) PCT Pub. No.: WO2015/009147

PCT Pub. Date: Jan. 22, 2015

(65) Prior Publication Data

US 2016/0251142 A1 Sep. 1, 2016

(30) Foreign Application Priority Data

Jul. 15, 2013 (NL) ..... 2011168
Jan. 27, 2014 (NL) ..... 2012149

(51) Int. Cl.
*B65H 3/00* (2006.01)
*G07F 11/00* (2006.01)
*B65D 83/04* (2006.01)

(52) U.S. Cl.
CPC .. *B65D 83/0409* (2013.01); *B65D 2583/0477* (2013.01); *B65D 2583/0481* (2013.01)

(58) Field of Classification Search
CPC ..... B65D 83/0409; B65D 2583/0477; B65D 2583/0481
(Continued)

(56) References Cited

U.S. PATENT DOCUMENTS 2,475,738 A 7/1949 Epplin
4,405,060 A * 9/1983 Hsei ..... B65D 83/0409 221/135
(Continued)

FOREIGN PATENT DOCUMENTS

DE 75 27 658 U 1/1979
DE 33 35 138 A1 5/1984
(Continued)

OTHER PUBLICATIONS

Search Report for corresponding Dutch Patent No. 2011168 dated Mar. 27, 2014.
(Continued)

*Primary Examiner* — Rakesh Kumar
(74) *Attorney, Agent, or Firm* — Renner, Otto, Boisselle & Sklar, LLP

(57) ABSTRACT

The invention relates to a dispenser (1) for dispensing substantially prismatic, in particular cube-shaped, tablets (5). In addition, the invention relates to an assembly of such a dispenser and several tablets to be dispensed. The invention furthermore relates to a method for dispensing substantially prismatic, in particular cube-shaped, tablets, in particular by using an assembly according to the invention.

25 Claims, 6 Drawing Sheets

Figure 1A:
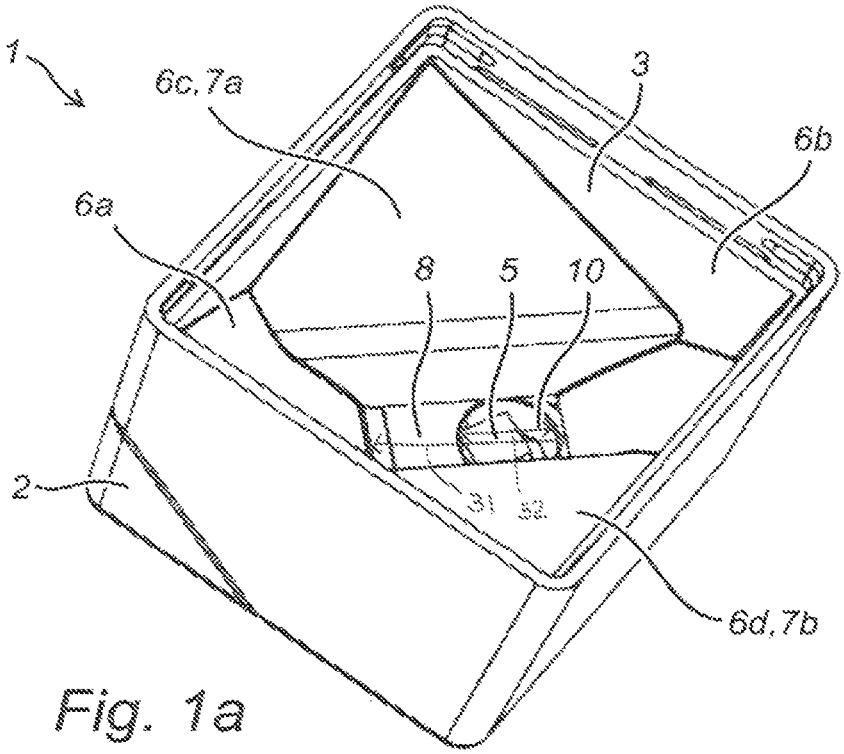

(58) Field of Classification Search
USPC ..... 221/1, 196, 190, 281, 65, 263, 243, 264, 221/152, 151
See application file for complete search history.

(56) References Cited

U.S. PATENT DOCUMENTS

| | | | | |
|---|---|---|---|---|
| 5,553,739 | A * | 9/1996 | Plum | B65D 83/0409 221/196 |
| 5,657,901 | A * | 8/1997 | Farside | B65D 83/0409 221/152 |
| 6,763,971 | B1 * | 7/2004 | Tong | G07F 11/44 221/151 |
| 2002/0175180 | A1 | 11/2002 | Evans et al. | |
| 2003/0234260 | A1 | 12/2003 | Giraud | |
| 2016/0251142 | A1 * | 9/2016 | Van Den Broek | B65D 83/0409 221/1 |

FOREIGN PATENT DOCUMENTS

| | | | | |
|---|---|---|---|---|
| DE | 3335138 | A1 * | 5/1984 | B65D 83/0409 |
| DE | 33 20 740 | A1 | 12/1984 | |
| DE | 3320740 | A1 * | 12/1984 | B65D 83/0409 |
| DE | 29708649 | U1 * | 7/1997 | A61J 1/03 |
| DE | 297 08 649 | U1 | 8/1997 | |
| EP | 0270010 | A2 * | 6/1988 | G01F 11/18 |
| EP | 090972 | A1 * | 11/1988 | |
| EP | 0614438 | B1 * | 4/1997 | B65D 83/0409 |
| FR | 2 928 356 | A1 | 9/2009 | |
| FR | 2928356 | A1 * | 9/2009 | A61J 7/0076 |
| GB | 2 013 636 | A | 8/1979 | |
| GE | de3320740 | A1 * | 6/1983 | |
| JP | H09-201400 | A | 8/1997 | |
| WO | 1993/011057 | A1 | 6/1993 | |
| WO | WO-9311057 | A1 * | 6/1993 | B65D 83/0409 |
| WO | 1998-013275 | A2 | 4/1998 | |
| WO | WO-9813275 | A2 * | 4/1998 | B65D 43/162 |
| WO | 2006/006370 | A1 | 1/2006 | |

OTHER PUBLICATIONS

International Search Report for corresponding International Application No. PCT/NL2014/050483 dated Oct. 20, 2014.
Written Opinion of the International Searching Authority for corresponding International Application No. PCT/NL2014/050483 dated Oct. 20, 2014.
International Preliminary Report on Patentability for corresponding International Application No. PCT/NL2014/050483 dated Jul. 1, 2015.

* cited by examiner

DISPENSER AND METHOD FOR DISPENSING PRISMATIC TABLETS

This application is a national phase of International Application No. PCT/NL2014/050483 filed Jul. 15, 2014 and published in the English language, which claims priority to Application Nos. NL 2011168 filed Jul. 15, 2013 and NL 2012149 filed Jan. 27, 2014.

The invention relates to a dispenser for dispensing substantially uniformly prismatic, in particular bar-shaped, more particularly cube-shaped, tablets. In addition, the invention relates to an assembly of such a dispenser and several tablets to be dispensed. The invention furthermore relates to a method for dispensing substantially prismatic, in particular cube-shaped, tablets, in particular by means of an assembly according to the invention.

Dispensers for successively releasing tablet-shaped or pill-shaped products, such as for example sweets, artificial sweeteners, medicines, pastilles, etc., are already known. An example of a known dispenser is described in international patent application WO2006/116370. The dispenser described in this patent comprises a housing which accommodates a storage container for tablet-shaped products. The storage container comprises a separate, resilient bottom element which adjoins a dispensing duct for the tablet-shaped products. The dispensing duct is provided with a dispensing opening at the end facing away from the storage container. Since the dispensing duct tapers in the direction of the dispensing opening, with the dimensioning of the dispensing duct being such that the tablets can only be conveyed through the dispensing duct sequentially, it is possible for the tablets to be dispensed successively. The tablets are dispensed by pushing in an upper wall of the storage container with respect to the surrounding housing, as a result of which the bottom element and thus the dispensing duct can be deformed in such a manner that the dispensing opening is formed and a single tablet can be dispensed. The drawback of the known dispenser is the fact that it only functions with the tablet-shaped products which have a rounded geometry. Products having a flatter geometry, such as prismatic products, in particular cube-shaped products, pile up in the storage container more quickly, thus significantly hampering and even preventing metered and controlled dispensation of products by the dispenser.

It is an object of the invention to provide an improved dispenser by means of which it is also possible to dispense prismatic, in particular cube-shaped, products in a relatively controlled and metered way.

To this end, the invention provides a device of the type mentioned in the preamble, comprising: at least one storage container for tablets, the underside of which storage container is provided with a first dispensing opening for tablets, at least one bottom element situated at a distance from the first dispensing opening, underneath the dispensing opening, and at least one separating element situated between the first dispensing opening and the bottom element and provided with a separating compartment for holding a single tablet to be dispensed, which separating compartment is open at the top side and bottom side, in which case the separating element is displaceable with respect to the first dispensing opening between: a loading position, in which the separating compartment adjoins the first dispensing opening and the bottom element, so that a tablet from the storage container will move as far as into the separating compartment with the tablet being supported by the bottom element, and an unloading position, in which the separating compartment is situated at a distance from the first dispensing opening, and in which a bottom side of the separating compartment is situated in line with a second dispensing opening for dispensing the separated tablet from the device, in which the bottom element and/or the storage container is provided with at least one tilting rib for tilting a tablet during displacement of the separating element from the loading position to the unloading position in such a way that a base surface of the substantially prismatic tablet comes to lie substantially parallel with the direction of displacement of the separating compartment, and in which at least one tilting rib is formed by an offset in the bottom element. When such tablets pile up, in which case base surfaces of different tablets engage with each other, this may result in a tablet, in the tilted position—under the effect of the force of gravity—ending up in the separating compartment in the loading position of the separating element, in particular due to the relatively flat geometry of prismatic tables. Due to the other tablets, as well as the friction between tablet and (side) walls of a dispensing device, this tilted position of the tablet to be separated can be maintained, which makes it more difficult to dispense an individual tablet as tablets situated above the latter may significantly hamper and may even prevent this desired displacement. By also tilting the tablet during displacement through the separating element, by allowing one or several tilting ribs which form part of the bottom element and/or the storage container to engage on the tablet, so it assumes a 'flat' orientation, in which the base surface and a copy of this base surface moved in translation, also denoted as top surface, of the tablet to be separated comes to lie substantially parallel with the direction of displacement of the separating element and separating compartment, it is ensured that the tablet experiences hardly any resistance during displacement from tablets which are situated above the latter and are still in the storage container. After all, the top surface of the tablet to be separated will generally assume a substantially horizontal orientation and will be able to readily slide with this orientation with respect to tablets situated above. A tablet which is immediately situated in the separating compartment in a flat orientation does not have to be tilted, since this tablet experiences hardly any resistance from the tablets situated above the latter during displacement. In the unloading position, the separating compartment is situated at a distance from the first dispensing opening, which means that the separating compartment does not adjoin the first dispensing opening and is thus separated from the first dispensing opening. Incidentally, it is conceivable that the tablet to be separated is not displaced, or hardly, with respect to the first dispensing opening during displacement of the separating element. In this case, the separating element may function, for example, as a hatch for separating the first dispensing opening and the separating compartment. The expression prismatic tablets is understood to refer to tablet-shaped products having a polyhedron which consists of an x-sided polygon as base surface, a y-sided top surface which is preferably formed by a copy of this base surface moved in translation, and n side surfaces which connect these two surfaces to each other. In this case, x and y may have the same value, but may also have different values. In this case, the number of side surfaces n is preferably greater than 1. Bottom surface and top surface of the tablets are thus oriented substantially parallel, both substantially flat, but both may, in the context of this patent, have a different shape and size. A particularly suitable tablet geometry which can be used advantageously in the device according to the invention is a geometry with a quadrangular base surface and a correspondingly quadrangular top surface, which are connected to each other by means of four side surfaces. Due to the type of geometry, this bar-shaped, in particular cube-shaped geometry, has several flat sides has which may engage with the sides of other tablets and may lead to a blockage in the device relatively quickly, compared to for example cylindrical tablets, but in which case this blockage may be removed by tilting the tablet to be separated, thus making dispensation of the tablet via the second dispensing opening possible. During dispensing of tablets by means of the device according to the invention, the tablets will move substantially vertically via the first dispensing opening (on account of the force of gravity), which is followed by a substantially horizontal and/or diagonal displacement as a result of the separating element, which is followed by a substantially vertical and/or diagonal displacement (on account of the force of gravity), in which case the tablet will fall from the separating compartment and may be dispensed via the second dispensing opening. The tablets are generally at least partly made from a foodstuff, such as sugar, milk powder, confectionary and/or a medicine, such as therapeutic and/or prophylactic substances.

In a preferred embodiment, at least one tilting rib forms an integral part of an inclined side wall of the storage container which is positioned in front of the separating compartment in the loading position of the separating element, viewed from the direction of displacement of the separating element from the loading position in the direction of the unloading position. In this case, the tilting rib is preferably formed by a bottom end of the inclined side wall. The tilting rib in this case preferably substantially adjoins a top side of the separating element. This prevents or minimizes the undesirable formation of gaps between the inclined side wall and the separating element. The aforementioned side wall is preferably inclined in a direction which partly corresponds to the direction of displacement of the separating element during displacement from the loading position to the unloading position. A (horizontal) component of the extending direction of the side wall is in this case parallel to the (horizontal) direction of displacement of the separating element during displacement in the direction of the unloading position. The incline does not have to be constant in this case. An incline having such an orientation makes it possible to push along tablets which are situated above, in the storage container during the displacement of the separating element from the loading position to the unloading position and to force them in an upward direction, which prevents undesired blockage of the tablets due to bridge formation in the storage container. The inclined side wall thus functions as a guide element for tablets, both in the downward direction (on account of the force of gravity) and in the upward direction (while pushing tablets situated in the storage container upwards). The tablets may be pushed upwards by means of a tablet which is situated in the separating compartment in tilted position and which carries along other tablets during displacement and/or by means of the moving separating element as such, for example by providing this separating element with a pushing element, as will be described in more detail below.

The separating compartment is preferably substantially cylindrical. A substantially cylindrical design makes it easier to place a tablet to be separated in the separating compartment. The diameter of the substantially cylindrical (or differently shaped) separating compartment is preferably greater than the largest body diagonal of the tablets used. As the tablets generally have a maximum dimension, i.e. the largest body diagonal, of 1 centimeter, the diameter of the separating element is preferably greater than 1 centimeter. In specific cases, in which smaller tablets are used, for example cube-shaped tablets with a body diagonal of 0.5 centimeters, a smaller separating compartment with a diameter of at least 0.5 centimeters suffices. As has already been mentioned above, the separating compartment is configured to hold and separate a single tablet. Therefore, it is preferable if the diameter of the separating element is smaller than twice the smallest dimension (length/width/height) of the tablets. In case of cube-shaped tablets having a rib length of for example 4 millimeters, the diameter of the separating compartment will preferably be greater than 6.93 mm (length of body diagonal) and smaller than 8 millimeters.

The height of the separating compartment, and thus preferably also of the separating element, preferably substantially corresponds to or is actually greater than the height of the tablet to be dispensed, viewed from the base surface of the tablet. This means that a tablet which is situated in the separating compartment in a flat orientation—in which the base surface and the top surface extend substantially parallel to the direction of displacement of the separating element and/or to a top side and bottom side of the separating element around the separating compartment—fits more or less accurately inside the separating compartment. On the one hand, this prevents the tablet from projecting with respect to the separating compartment. On the other hand, this additionally prevents other tablets from being able to position themselves in the separating compartment. Generally, depending on the dimensions of the tablets used, the height of the separating compartment will be between 0.4 and 1.0 centimeter.

The at least one tilting rib de facto forms an obstacle for the tablet to be separated during displacement of the tablet, which obstacle forces a tilting moment in the tablet, as a result of which the tablet will be tilted in the direction of the desired flat orientation. The tilting rib is preferably positioned underneath or near the first dispensing opening, so that the tablet to be separated will be tilted direct after the start of the displacement, in which the tablet generally is in contact with the tablets situated above, before the tablet is displaced further. The tilting thus preferably takes place immediately or virtually immediately after the displacement of the tablet has started. During the displacement, the tablet which is positioned in a flat orientation will be brought at a distance from the first dispensing opening and will eventually be brought in line with the second dispensing opening.

The tilting rib is formed by an offset in the bottom element. An offset in the upward direction—viewed in the direction of displacement of the separating element from the loading position to the unloading position—results in a kind of threshold over which or on which the tablet to be separated is pushed, resulting in the tilting of the tablet. This offset is preferably gradual, so that the tablet is prevented from being blocked by the offset. The offset is preferably positioned such that tilting of the tablet can take place before the tablet is brought out of line with the first dispensing opening, in order to prevent the tablet from being tilted by the storage container. Preferably, the shortest distance between the (higher part of the) bottom element, in particular the tilting rib, and a side wall of the storage container is greater than the height of the tablets used, as a result of which the tablet is not clamped between the side wall and the bottom element or blocked by the side wall and the bottom element. The tilting rib is preferably positioned in such a manner that the tilting effect with respect to a tablet to be separated is achieved before the tablet passes a side wall of the storage container, in order to prevent the side wall of the storage container from blocking the displacement of the tablet. To this end, it is advantageous if the distance between the side wall and a front part of the tilting rib, i.e. the part of the tilting rib facing the side wall, is larger than the largest dimension (base surface diagonal or base surface diameter) of the base surface of the tablet or is at least larger than 0.5 times the largest dimension (base surface diagonal or base surface diameter) of the base surface of the tablet, as a tablet will start tilting halfway along the tilting rib. Generally, a side wall of the storage container, in the direction of which the separating element is displaced during displacement from the loading position to the unloading position, will act as a stripping wall, via which other tablets will be displaced in a direction facing away from the tablet to be separated. It is likewise conceivable for the storage container itself to be provided with a tilting rib, against which a tablet displaced by means of the separating element is pushed in order to achieve a desired tilting of the tablet. In this case, it is conceivable for the at least one tilting rib to form an integral part of a side wall of the storage container.

Displacement of the separating element is preferably carried out in a single plane. This plane may be horizontal or diagonal. This makes it possible to move the separating element according to a linear path, which is advantageous from a constructional point of view, partly because the separating element can be made as a single part. Incidentally, it is conceivable for the separating element to be configured such that a tablet is displaced along a non-linear path, in particular a two-dimensional or even three-dimensional path. However, to this end, the separating element will generally have to be made of several parts, which is generally less advantageous from a constructional and financial point of view, but could nevertheless be preferable from the point of view of, for example, design. Causing the tablet to be separated to undergo a single rotary movement could be realised by using a device which is more or less as complicated from a constructional perspective as a device configured for linear displacement of the tablet to be separated. Displacement of the separating element is preferably effected manually. However, it is also conceivable to carry out this displacement electromechanically or electromagnetically, which will, however, increase the cost price of the device. If a manually operable separating element is used, a user will be able to move the separating element from the loading position to the unloading position by pushing a generally end side of the separating element. Optionally, the device may be provided with at least one pressure element, in particular a compression spring, in order to force the separating compartment back into the loading position. In this way, it is possible to push the separating element manually from the loading position to the unloading position, in which case the separating element is pushed back into the loading position on account of the at least one pressure element, after a user has released the separating element.

In order to prevent an uncontrolled movement by the separating element with respect to the storage container and/or unintentional removal of the separating element with respect to the storage container, it is advantageous if the maximum displacement of the separating element is limited by at least one limiting element, in particular a cam. In this case, it is conceivable for one or several cams to form part of the storage container or to be connected to the storage container, in which case the cams may also at least partly grip around and hold the separating element. It is conceivable for the bottom element and the storage container to be connected to each other. It is conceivable for the bottom element and the separating element to be connected to each other and even for the bottom element to form part of the separating element. In this case, the bottom element may also be configured as a hatch in which the orientation of the bottom element with respect to the storage container can be changed, in particular is tiltable and/or displaceable, between a loading position, in which the bottom element is configured to support a tablet to be separated, and an unloading position, in which the bottom element is configured to create the second dispensing opening in order to release a separated tablet. It is furthermore conceivable that this mutual connection limits the (maximum) displacement of the separating element. In this case, it is conceivable that this mutual connection, which optionally employs one or several connecting elements, limits the maximum limit and/or forms a guide for the separating element which defines the displacement path of the separating element.

Preferably, the diameter of the first dispensing opening is greater than the diameter of the separating compartment. This increases the accessibility of the separating compartment for the tablets. In addition, this makes it possible for the separating element to partly close off the first dispensing opening in the loading position, so that the separating element is also configured to support tablets which are situated in the storage container. Preferably, the part of the separating element partly closing off the first dispensing opening is provided with at least one pushing element, such as for example a pushing rib, in order to push the tablets which are situated in the storage container upwards during displacement of the separating element from the loading position to the unloading position. This makes it possible to push tablets in the storage container upwards and thus to cause them to move, which facilitates displacement and optional tilting of the tablet to be separated. This shake-up effect of tablets situated in the storage container is particularly effective if, in addition to the aforementioned pushing element, an opposite side wall of the storage container is also configured to be inclined, so that the side wall is inclined in a direction which partly corresponds to the direction of displacement of the separating element during displacement from the loading position to the unloading position, as has already been described above.

The first dispensing opening and the second dispensing opening are preferably not in line. This makes it possible to isolate (separate) a tablet to be separated relatively easily from the other tablets remaining in the storage container. The dispensing openings not being in line means that the axes of both dispensing openings do not coincide. Preferably, the dispensing openings do not overlap at all. This has the advantage that the storage container can be closed off relatively well by positioning the separating element in the loading position which, on the one hand, benefits the storage life of the tablets situated in the storage container and, on the other hand, prevents the undesired dispensation of remains of tablets, such as tablet dust. As has already been mentioned above, it is also conceivable that the first dispensing opening and the second dispensing opening to nevertheless be positioned in line. In this case, the separating element may be configured such that, in the loading position, it closes off the second dispensing opening and opens the first dispensing opening and, in the unloading position, closes off the first dispensing opening and opens the second dispensing opening. In this case, the bottom element may optionally form an integral part of the separating element.

The peripheral wall of the storage container is preferably formed by one or several mutually connected side walls. These side walls enclose a compartment in which the tablets can be stored. At first sight, it is conceivable to use only a single side wall, for example a cylindrical side wall. However, it will generally be preferred to use several side walls in order to allow the displacement of the tablets in the storage container to proceed in a more controlled manner. In this case, it is conceivable for at least two opposite side walls to mutually enclose a groove which is situated above the separating element. This groove serves as a sorting space for tablets which will successively move as far as into the separating compartment. In this case, it is advantageous if the width of the groove is greater than the length of the longest body diagonal of a tablet and is smaller than twice the smallest dimension of the tablets. As a result of such dimensioning, only one row of tablets will fit into the groove, viewed from above. In a particularly preferred embodiment, each of the two opposite side walls which enclose a groove comprise a substantially vertical bottom wall part which is positioned near the separating element and a diagonal top wall part which is connected to the substantially vertical wall part. The vertical wall parts allow quick downward displacement of tablets and preferably define the (fall) groove in the storage container. The diagonal wall parts push the tablets in the direction of the (fall) groove and, on the other hand, provide more storage volume for tablets in the storage container. It is advantageous if the height of a bottom wall part of one side wall is not equal to the height of the bottom wall part of an opposite side wall. As a result thereof, the tablets will, when they are moved about in the storage container, for example by means of the moving separating element, prefer to move in the direction and on the top wall part which adjoins the least high vertical wall part, which prevents blockage of tablets in the storage container during displacement of the tablets. This will then make it easier to provide a new tablet in the separating compartment.

The second dispensing opening may be arranged in the bottom element, which may be advantageous from a constructional point of view as the separating element is delimited at a bottom side by the bottom element. However, it is also conceivable for the second dispensing opening to only adjoin the bottom element or even to be situated at a distance from the bottom element. The second dispensing opening may only be formed by an opening, but may also be provided with, for example, a linear or non-linear fall pipe.

Generally, the separating element will close off the first dispensing opening substantially completely in the unloading position of the separating element. This prevents tablets located in the storage container from (partly) positioning themselves between the storage container and the bottom element, which could have an adverse effect on the correct operation of the device.

It is conceivable for the device to comprise several storage containers and/or several separating elements. The use of several storage containers makes it possible to keep different kinds of tablets in one device. In this case, each storage container cooperates with one or several separating elements. A user can thus cause a selected storage container to dispense a tablet as desired, by operating the associated separating element. In addition, it is conceivable for a single storage container to cooperate with several separating elements simultaneously. This makes it possible to adjust the dosage from a single storage container as desired, in which case several tablets (of the same type) can be dispensed simultaneously by the storage container, for example by simultaneous operation of several separating elements.

The device is preferably configured as a handheld device, so that it can readily be held and operated in one hand by a user. Preferably, the device is substantially made from plastic which renders the device durable and relatively lightweight.

The invention also relates to an assembly of a device according to the invention and several substantially prismatic, in particular cube-shaped, tablets which are held in the storage container of the device. As has already been indicated, the tablets comprise at least one substance selected from the group comprising: a drug, vitamins, minerals, sugar, milk powder and confectionary. Generally, each tablet will have a substantially prismatic shape, in which a base surface of the tablet has a maximum width and/or length and/or diameter of 1 centimeter, preferably 0.5 centimeters, and in which the height of the tablet is at most 1 centimeter, preferably 0.5 centimeters. The height of the separating compartment preferably substantially corresponds to the height of a tablet viewed from the base surface of the tablet. However, in practice, the dimensioning of the tablets used may also differ (greatly) from the abovementioned dimensioning.

In addition, the invention relates to a method for dispensing substantially prismatic, in particular cube-shaped, tablets, in particular by using an assembly according to the invention, comprising the following steps: A) providing a device for dispensing substantially prismatic tablets, comprising: at least one storage container for tablets, which storage container is provided with a first dispensing opening for tablets at a bottom side, at least one bottom element which is positioned at a distance from the first dispensing opening, underneath the dispensing opening, and at least one separating element which is positioned between the first dispensing opening and the bottom element and provided with a separating compartment configured to hold a single tablet to be dispensed, which separating compartment is open at a top side and a bottom side, in which the separating element is displaceable with respect to the first dispensing opening and the bottom element between: a loading position, in which the separating compartment adjoins the first dispensing opening and the bottom element, so that a tablet will move from the storage container as far as into the separating compartment with the tablet being supported by the bottom element, and an unloading position, in which the separating compartment is situated at a distance from the first dispensing opening, and in which a bottom side of the separating compartment is situated in line with a second dispensing opening for dispensing the separated tablet from the device, in which the bottom element and/or the storage container is provided with at least one tilting rib for tilting a tablet during displacement of the separating element from the loading position to the unloading position in such a way that a base surface of the substantially prismatic tablet comes to lie substantially parallel with the direction of displacement of the separating compartment, and in which the storage container is at least partly filled with tablets to be dispensed, wherein at least one tilting rib is formed by an offset in the bottom element; B) positioning the separating element in the loading position, C) causing a tablet to be dispensed to be positioned in the separating compartment via the first dispensing opening, D) displacing the separating element from the loading position in the direction of the unloading position, in which case the tablet, if the base surface of the tablet is not parallel to the direction of displacement of the tablet, during this displacement, is tilted by the at least one tilting rib so that the base surface of the tablet comes to lie substantially parallel to the direction of displacement of the separating compartment, and E) removing the separated tablet from the separating compartment in the unloading position of the separating element via the second dispensing opening. During step D), the first dispensing opening is preferably substantially completely closed off by the separating element. It is furthermore advantageous if the tablets situated in the storage container are pushed upwards by the moving separating element. To this end, a top side of the separating element is provided with at least one offset, in particular a bevel.

Figure 1B:
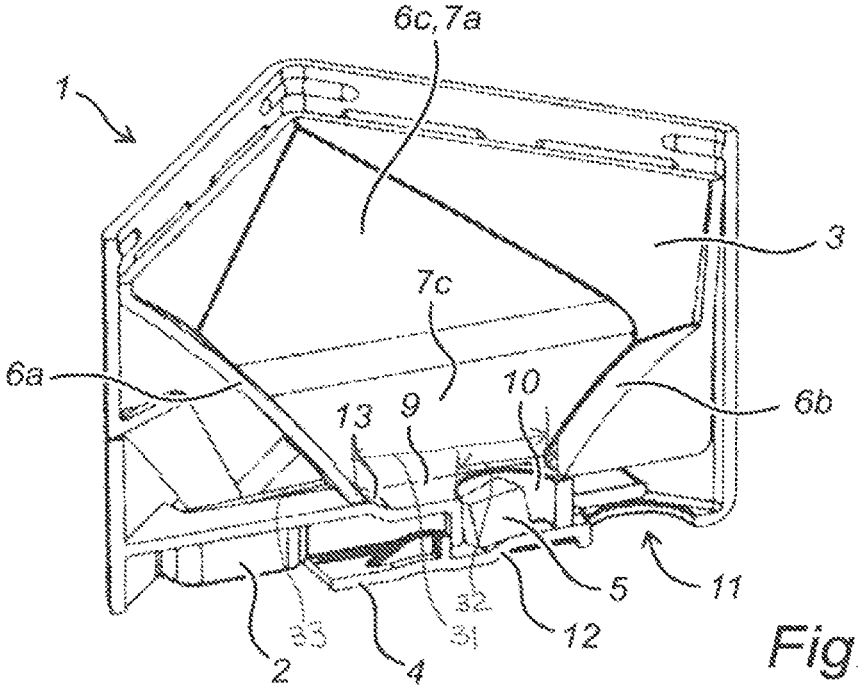
Figure 2A:
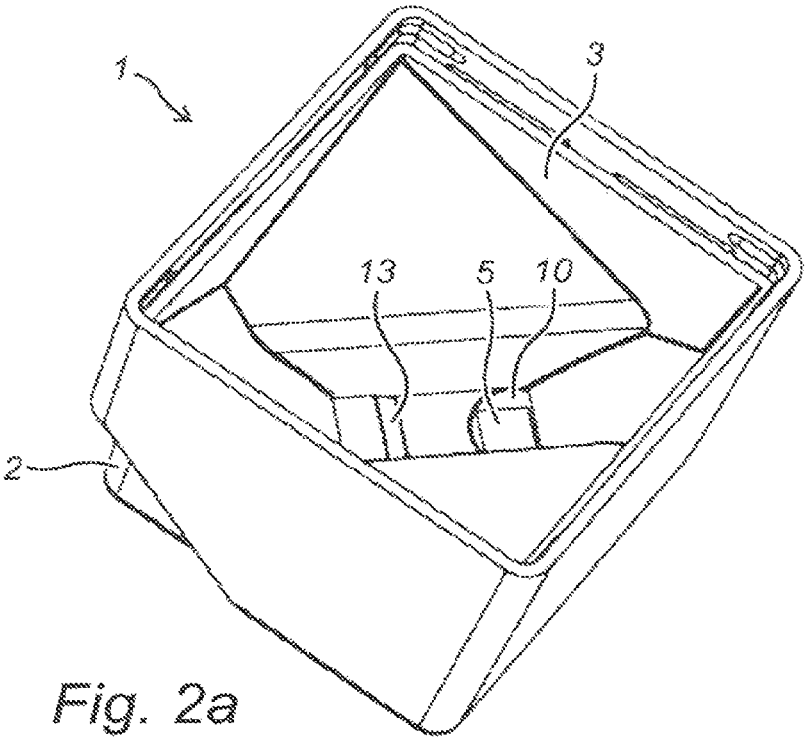
Figure 2B:
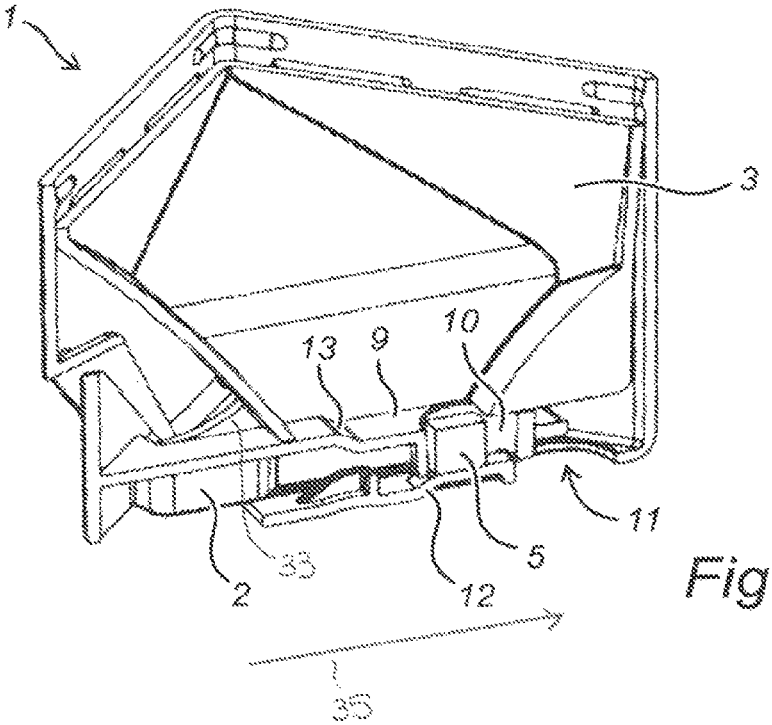
Figure 3A:
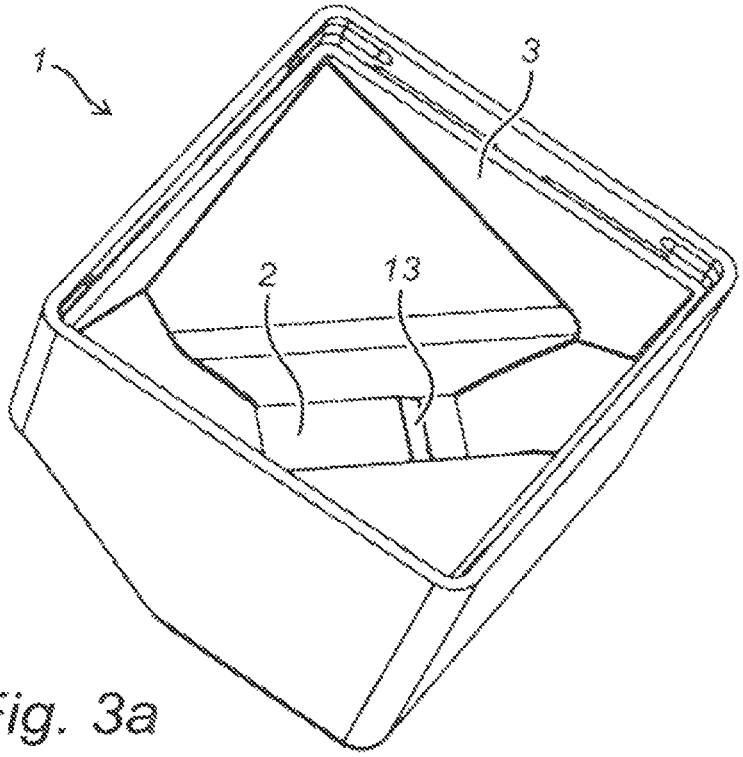
Figure 3B:
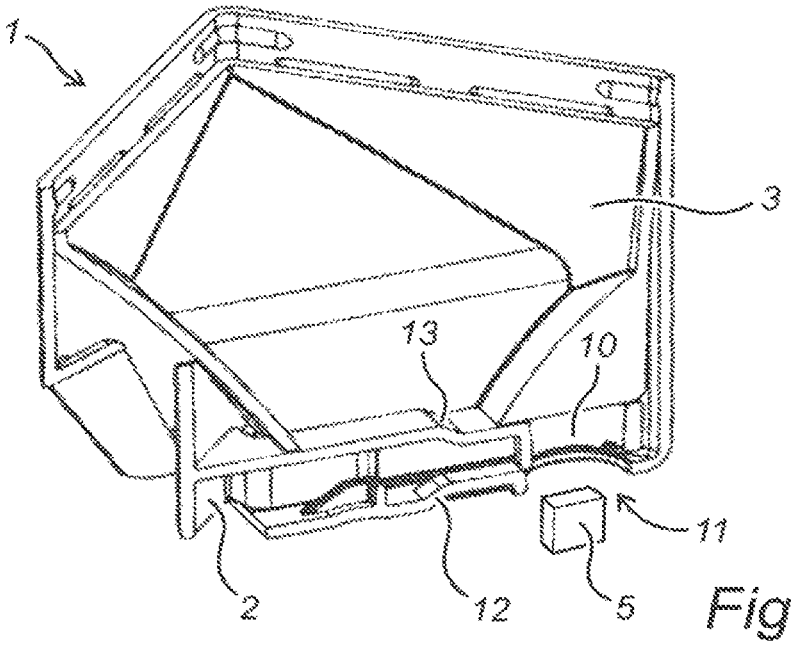
Figure 4:
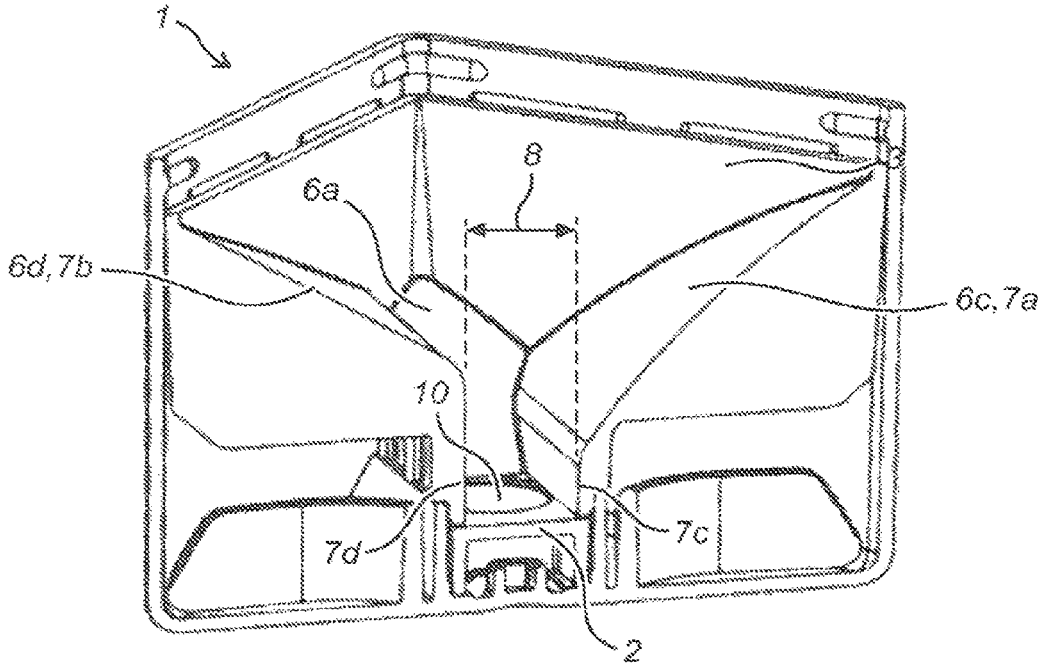

The invention will be explained by means of the non-limiting exemplary embodiments illustrated in the following figures, in which:

FIGS. 1*a* and 1*b* show a perspective view of respectively a cross section of a device according to the invention, in which a separating element is in the loading position, FIGS. 2*a* and 2*b* show a perspective view of respectively a cross section of the device according to the preceding figures, in which the separating element is in an intermediate position between the loading position and the unloading position, FIGS. 3*a* and 3*b* show a perspective view of respectively a cross section of the device according to the preceding figures, in which the separating element is in the unloading position, FIG. 4 shows a perspective view of another cross section of the device as illustrated in FIGS. 1*a* and 1*b*, and FIGS. 5*a*-5*c* show successive cross sections of a portable device according to the invention during removal of a tablet from the device.

FIGS. 1*a* and 1*b* show a perspective view of respectively a cross section of a portable device 1 according to the invention, in which a separating element 2 is in the loading position. In addition to a separating element 2, the device 1 comprises a storage container 3 and a bottom element 4 connected to the storage container 3. The storage container 3 and the bottom element together form a housing of the device 1. Although not illustrated in the figures, a top side of the storage container 3 can be closed off by means of a lid (not shown). The storage container 3 and the bottom element 4 are made from plastic, as is the separating element 2. The separating element 2 is held securely by the housing of the device 1, but is displaceable with respect to the housing between the illustrated loading position and an unloading position as illustrated in FIGS. 3*a* and 3*b*. The storage container 3 can be filled with various types of tablets of different geometries which may successively be dispensed by the device 1. However, in contrast to known devices, the device 1 is particularly suitable for dispensing substantially prismatic tablets in a controlled manner. This is understood to mean tablets which have a substantially flat base surface and a substantially flat top surface, which surfaces are oriented substantially parallel with respect to each other. An example of a prismatic tablet is a cube-shaped tablet 5, as illustrated in the figures. Generally, the storage container will be completely or partly filled with such tablets 5. For the sake of clarity of the figures, these further tablets 5 are not shown. The storage container 3 comprises two opposite curved side walls 6*a*, 6*b* and two opposite angled flat side walls 6*c*, 6*d*. The angled side walls each have a top wall part 7*a*, 7*b* and a bottom wall part 7*c*, 7*d*. The transition between a top wall part 7*a*, 7*b* and a bottom wall part 7*c*, 7*d* may be sharp (discontinuous) (see FIGS. 5*a*-5*c*), but may also be more gradual (continuous) (see FIGS. 1*a*-4) by allowing the top wall part 7*a*, 7*b* and the bottom wall part 7*c*, 7*b* to adjoin each other by means of a curvature. A sharp (discontinuous) transition between the top wall part and an adjoining bottom wall part is generally preferred in order to prevent tablets 5 from becoming stuck. The bottom wall parts 7*c*, 7*d* are oriented substantially vertically and enclose a (fall) groove 8 which is slightly wider than the largest body diagonal of a tablet 5, but preferably smaller than twice the smallest dimension (=rib length) of the tablet 5, so that a single row of tablets—in top view—can form in the groove. The heights of the vertical wall parts 7*c*, 7*d* are not equal, thus significantly facilitating displacement of tablets 5 in the storage container and preventing tablets 5 from becoming stuck. Preferably, the height of the least high vertical wall part substantially corresponds to at least 1 to 1.5 times the largest dimension (rib length) of the tablets 5 used. Such a limited height has the advantage that the volume of the storage container becomes relatively large, which benefits the storage capacity of the device 1. However, the height of the least high vertical wall part is preferably sufficiently high and/or wide to allow several tablets to fit between the vertical wall parts, which will usually be advantageous for the dispensation process. These several tablets may be positioned between the vertical wall parts on top of each other and/or next to each other. All this is also illustrated in FIG. 4. At a bottom side, the side walls 6*a*-6*d* discharge into a first dispensing opening 9. This dispensing opening 9 adjoins a part of the separating element 2. In this case, the separating element 2 is provided with a substantially cylindrical separating compartment 10. The diameter 31 of the first dispensing opening is greater than the diameter 32 of the separating compartment. The diameter of this separating compartment 10 has a diameter which is greater than the body diagonal of the cube-shaped tablet 5, but is smaller than twice the smallest dimension of the cube-shaped tablet 5. On the one hand, this makes it possible to position a tablet in the separating compartment 10 in any desired orientation and, on the other hand, prevents several tablets 5 from entering the separating compartment 10 simultaneously. The separating compartment 10 is thus suitable for holding a single tablet. As a tablet 5 will generally position itself in the separating compartment in an unpredictable way and with an arbitrary orientation, it often happens that the tablet 5 does not position itself in the separating compartment 10 in a flat orientation, with the base surface and top surface of the tablet 5 being positioned substantially horizontally and substantially parallel with the direction of displacement 35 of the tablet 5. With such a flat orientation, the tablet 5 will be displaced relatively easily by means of the separating element 2 in the direction of a second dispensing opening 11 which is provided in the bottom element 4, where the tablet 5 will fall from the separating compartment 10 and will be removed from the device 1 via the second dispensing opening 11. This latter orientation of the separating compartment 10 and consequently of the separating element 2 is also referred to as the unloading position (see FIGS. 3*a* and 3*b*). During displacement of the tablet 5 of the loading position in the direction of the unloading position, the top surface of the tablet 5, when the tablet 5 is positioned in a flat orientation, will slide off with respect to any tablets situated above, which can be effected relatively easily in an unimpeded manner.

However, generally the tablets 5 are not in a desired flat orientation, but in a tilted, oblique orientation, as is illustrated in FIGS. 1*a* and 1*b*. Upon displacement of the tilted tablet 5 in the direction of the unloading position, a flat side of the tablet 5 will generally engage with another tablet, as a result of which the displacement may be rendered significantly more difficult and may even be prevented. Therefore, the device 1 according to the invention provides one or several tilting ribs. In FIGS. 1*a*-4, only one tilting rib 12 has been used. This tilting rib 12 is formed by a gradual elevation (offset) of the bottom element 4, viewed in the direction of the unloading position, as a result of which a threshold is formed for the tablet 5 on which the tablet 5 will tilt towards a flat orientation (see FIGS. 2*a* and 2*b*) during its displacement in the direction of the unloading position, after which a smooth and relatively unimpeded displacement is made possible. Thus, immediately or virtually immediately after the tablet 5 has been set in motion by displacing the separating element 2 in the direction of the unloading position, the tablet 5 will be tilted by the tilting rib 12, after which a smooth further displacement of the tablet 5 is made possible. The tablets which are situated on top of the tablet 5 to be separated are pushed against the side wall 6*b*, which prevents these other tablets from preventing the movement of the tablet 5 to be separated. This smooth displacement is improved further by the fact that a top side of the separating element is provided with a pushing element 13 which will displace the tablets in the storage container 3 during displacement of the separating element 5 in the direction of the unloading position. As the bottom wall parts 7*c*, 7*d* of the side walls 6*c*, 6*d* of the storage container 3 are not of equal height, the pushed tablets 5 will tend to move in the direction of the side wall 6*c* having the lowest bottom wall part 7*c*. This lateral pushing movement causes any blockages formed by tablets 5 to be released as much as possible, which is advantageous for the overall displacement process of the tablet 5 to be separated. In the unloading position of the separating element 2, the first dispensing opening 9 is closed off completely by the separating element 2, in which case the separating compartment 10 is also situated at a distance from the first dispensing opening 9. Displacement of the separating element 2 from the loading position to the unloading position is generally carried out manually, by a user pushing against an end side 2*a* of the separating element 2. Returning the separating element 2 from the unloading position as far as into the loading position may also be effected manually, but generally, a pressure element, such as a spring 33, will be provided between the housing and the separating element 2 which tends to push the separating element 2 back into the loading position.

Figure 5A:
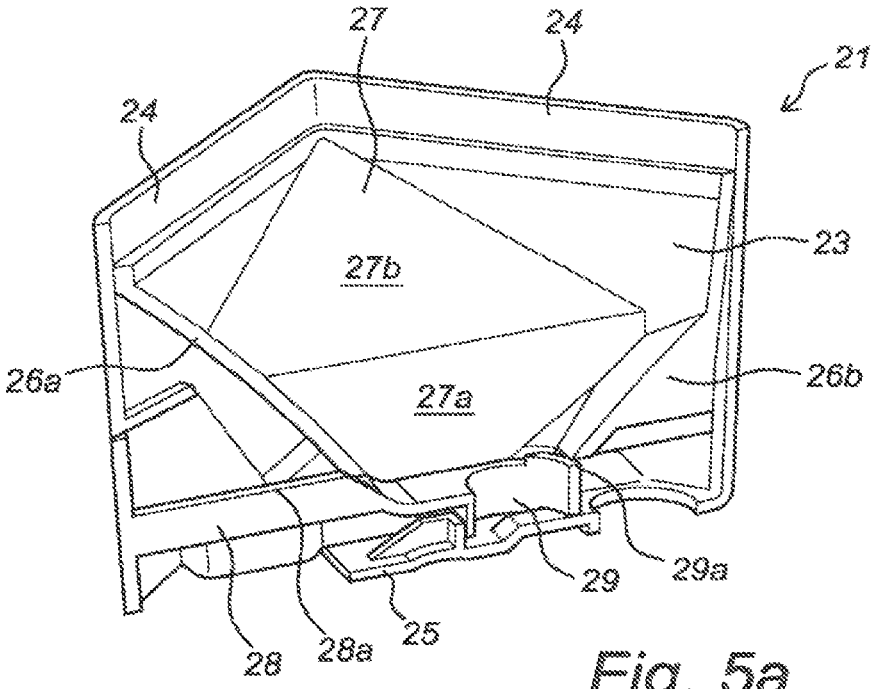
Figure 5B:
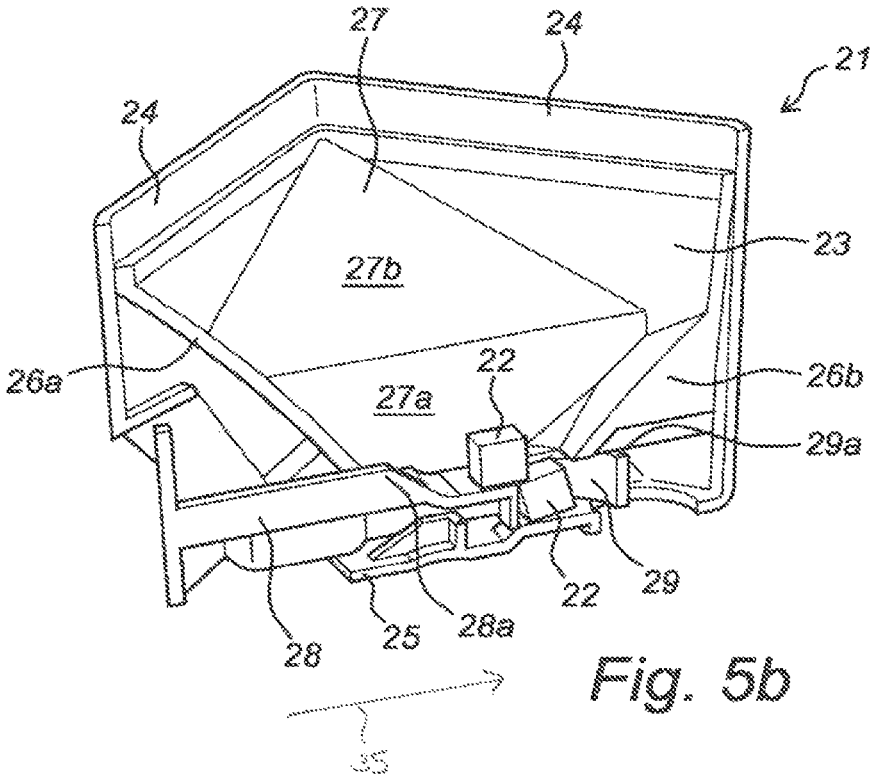
Figure 5C:
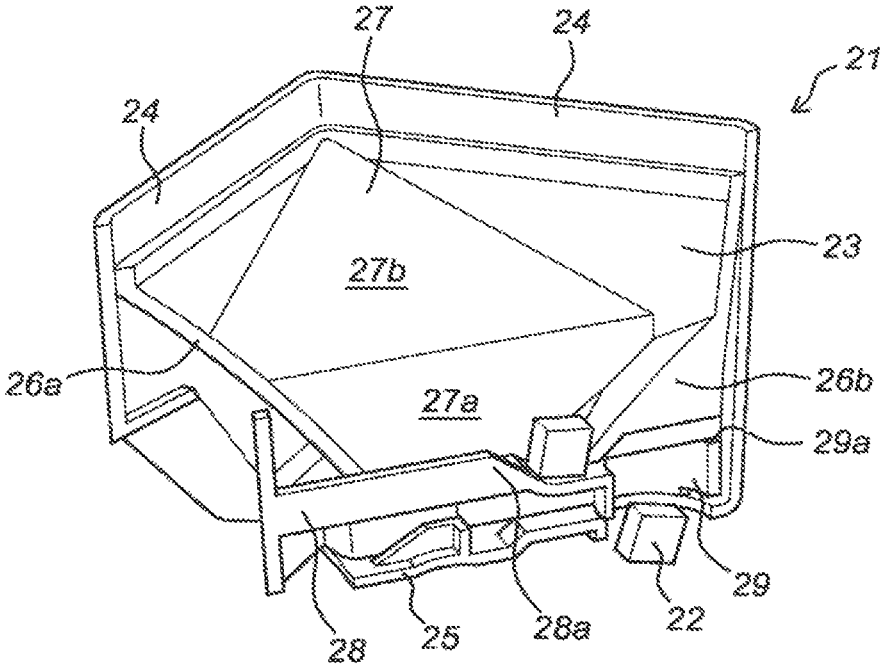

FIGS. 5*a*-5*c* successively show cross sections of a portable device 21 according to the invention during removal of a tablet 22 from the device 21. For the sake of clarity of the illustration of the device 21, the tablets 22 are not shown in FIG. 5*a*. Constructionally, the device 21 substantially corresponds to the device 1 shown in the preceding figures. The device 21 comprises a funnel-shaped storage container 23 for keeping tablets 21 to be dispensed in stock. The tablets 22 are substantially cube-shaped, for example having the dimensions 4×4×4 millimeters, and are preferably at least partly made from a substance chosen from the group consisting of: a pharmaceutical substance, vitamins, minerals, sugar, sweetener, milk powder and confectionary. During use, the storage container 23 is closed off at a top side by an optionally removable lid (not shown). An outer side of the device 21 is defined by four side walls 24 connected to each other and an open bottom element 25 connected to the side walls 24. The storage container 23 is formed by funnel-shaped internal parts 23 which are pushed into the space formed by the side walls 24. The internal parts 23 defining the storage container in this case tightly adjoin on inner side of the side walls 24 of the device 21. The internal parts 23 thus de facto function as the housing of the storage container 23. The internal parts 23 comprise two curved side walls 26*a*, 26*b* which extend in line with a direction of displacement 35 of a tablet 22 to be dispensed. The internal parts 23 furthermore comprise two angled side walls 27, only one side wall of which is illustrated. Each angled side wall 27 comprises a vertical wall part 27*a* and a diagonal wall part 27*b*, in which the transition between both wall parts 27*a*, 27*b* is sharp (discontinuous), thus preventing a blockage caused by a pile of tablets 22. The opposite vertical wall parts 27*a* differ from each other in height, which results in an asymmetry which further reduces a blockage caused by a pile of tablets 22. A bottom side of the internal parts 23 is provided with a separating element 28 which is displaceably coupled to the internal parts 23. The separating element 28 is displaceable with respect to the internal parts 23 between a loading position (FIG. 5*a*) and an unloading position (FIG. 5*c*). The separating element 28 is provided with pressure means, generally a sprung element (not shown) in order to push the separating element 28 into the loading position. The separating element 28 is provided with a substantially cylindrical separating compartment 29 configured to accommodate a single tablet 22. The diameter of this separating compartment 29 has a diameter which is larger than the body diagonal of the cube-shaped tablet 22, but smaller than twice the smallest dimension of the cube-shaped tablet 22. This makes it possible, on the one hand, for a tablet to position itself in any desired orientation in the separating compartment 29 and prevents, on the other hand, several tablets 22 from being able to occupy the separating compartment 29 simultaneously. Due to the fact that a tablet 22 will generally position itself in the separating compartment 29 in an unpredictable way and with an arbitrary orientation, the tablet 29 will often not be positioned in a flat orientation in the separating compartment 29, which may significantly hamper dispensation of the tablet 22. Therefore, it is advantageous to tilt a tablet 22 situated in the separating compartment 29 during displacement of the separating element 28 in such a way that it has a flatter orientation, so that the cube-shaped tablet 22 can be separated relatively easily from any other tablets situated in the storage container 23. This tilting of the tablet 22 is achieved, on the one hand, by an offset 30 in the bottom element 25. On the other hand, tilting the tablet 22 can be achieved by one of the curved walls 26*b* of the storage container 23 with which the tablet 22 to be dispensed may cooperate in a non-flat orientation. This curved wall 26*b* also ensures that a tablet 22 situated above a tablet 22 to be dispensed is separated therefrom by sliding it off the latter. A front side 29*a* of the separating compartment 29, in the loading position adjoining the aforementioned curved wall 26*b*, is configured to be higher, thus preventing the tablets 22 in the device from becoming stuck. In this exemplary embodiment, the front side 29*a* is 1 millimeter higher than another part of the peripheral side of the separating compartment 29. A rear part of the separating element 28 is provided with an elevated portion 28*a* in order to push tablets 22 in an upward direction during displacement of the separating element 28 in the direction of the unloading position. In order to save material, this elevated portion 28*a* does not have to extend across the entire width of a sorting groove (or fall groove) defined by the vertical wall parts 27*a*, but the elevated portion 28*a* may be configured to have a more limited width, as a result of which the elevated portion 28*a* is de facto formed by a (pushing) rib. The elevated portion 28*a* preferably adjoins a part of the separating element 28 which is situated at a lower level in a substantially smooth way, thus facilitating the sliding of tablets 22 on the elevated portion 28*a*. In this exemplary embodiment, the height of the elevated portion substantially corresponds to one time the rib length of a tablet 22. The height of the sorting groove is approximately twice the rib length of a tablet 22.

It will be clear that the invention is not limited to the exemplary embodiments illustrated and described here, but that many variants are possible within the scope of the attached claims which are obvious to the person skilled in the art.

The inventive concepts described above are illustrated by means of several illustrative embodiments. It is conceivable for individual inventive concepts to be applied without likewise applying other details of the described example. It is not necessary to develop examples of all conceivable combinations of the above-described inventive concepts further, as a person skilled in the art will understand that several inventive concepts can be (re)combined to arrive at a specific application.

The invention claimed is:

1. Device for dispensing substantially prismatic, in particular cube-shaped, tablets, comprising:

A) at least one storage container for tablets, the storage container is provided on an underside with a first dispensing opening for tablets, B) at least one bottom element situated at a distance from the first dispensing opening, underneath the first dispensing opening, and C) at least one separating element situated between the first dispensing opening and the bottom element and provided with a separating compartment for holding a single tablet to be dispensed, the separating compartment is open at a top side and bottom side, wherein the separating element is displaceable in a direction of displacement with respect to the first dispensing opening between:

a loading position, in which the separating compartment adjoins the first dispensing opening and the bottom element, so that a tablet from the storage container will move into the separating compartment with the tablet being supported by the bottom element, and an unloading position, in which the separating compartment is situated at a distance from the first dispensing opening, and in which the bottom side of the separating compartment is situated in line with a second dispensing opening for dispensing the separated tablet from the device, wherein the bottom element is provided with at least one tilting rib for tilting a tablet during displacement of the separating element from the loading position to the unloading position in such a way that a base surface of the substantially prismatic tablet comes to lie substantially parallel with the direction of displacement of the separating compartment, and wherein the at least one tilting rib is formed by an offset in the bottom element.

2. Device according to claim 1, in which the separating compartment is substantially cylindrical.

3. Device according to claim 1, wherein at least one tilting rib forms an integral part of a side wall of the storage container and/or of the bottom element.

4. Device according to claim 3, wherein at least one tilting rib forms an integral part of an inclined side wall of the storage container which is positioned in front of the separating compartment in the loading position of the separating element, viewed from the direction of displacement of the separating element from the loading position to the unloading position.

5. Device according to claim 4, in which the side wall is inclined in a direction which partly corresponds to the direction of displacement of the separating element during displacement from the loading position to the unloading position.

6. Device according to claim 1, in which at least a part of a top side of the separating element is configured to support tablets which are situated in the storage container.

7. Device according to claim 1, in which the separating element is configured to be displaced manually by a user between the loading position and the unloading position.

8. Device according to claim 1, wherein the separating element is configured to be pushed from the loading position to the unloading position manually.

9. Device according to claim 1, wherein the device is provided with at least one pressure element for pushing the separating compartment into the loading position.

10. Device according to claim 1, in which a maximum displacement of the separating element is limited by at least one limiting element, in particular a cam.

11. Device according to claim 1, in which the diameter of the first dispensing opening is larger than the diameter of the separating compartment.

12. Device according to claim 8, wherein the first dispensing opening is partly closed off by the separating element in the loading position, so that the separating element is also configured to support tablets which are situated in the storage container.

13. Device according to claim 12, in which the part of the separating element partly closing off the first dispensing opening is provided with at least one pushing element for pushing tablets in the storage container upwards during displacement of the separating element from the loading position to the unloading position.

14. Device according to claim 1, in which the first dispensing opening and the second dispensing opening are out of line.

15. Device according to claim 1, in which the bottom element and the storage container are connected to each other.

16. Device according to claim 1, in which a peripheral wall of the storage container is formed by several mutually connected side walls.

17. Device according to claim 16, in which at least two opposite side walls mutually enclose a groove which is situated above the separating element.

18. Device according to claim 17, in which each of the two opposite side walls which mutually enclose a groove comprises a substantially vertical bottom wall part which is positioned near the separating element, and a diagonal top wall part which is connected to the substantially vertical wall part.

19. Device according to claim 18, wherein a first bottom wall part has a first height and an opposing second bottom wall part has a second height, and the first height is not equal to the second height.

20. Device according to claim 1, in which the second dispensing opening is arranged in the bottom element.

21. Device according to claim 1, in which the separating element closes off the first dispensing opening substantially completely in the unloading position of the separating element.

22. Device according to claim 1, in which the separating element is displaceable according to a substantially linear path.

23. Device according to claim 1, in which the separating element is enclosed between the storage container and the bottom element.

24. Device according to claim 1, wherein the device is a hand device.

25. Device according to claim 1, wherein the at least one pressure element is a spring.

* * * * *